US005868258A

United States Patent [19]

Hubbard, Jr.

[11] Patent Number: 5,868,258

[45] Date of Patent: Feb. 9, 1999

[54] PLASTIC LIGHTWEIGHT MAGNETIC SWEEPER

[75] Inventor: DeHart Hubbard, Jr., 4300 7th. Ave., Chattanooga, Tenn. 37407

[73] Assignee: DeHart Hubbard, Jr., Chattanooga, Tenn.

[21] Appl. No.: 604,577

[22] Filed: Feb. 21, 1996

[51] Int. Cl.[6] ..... B03C 1/00

[52] U.S. Cl. ..... 209/215; 209/614

[58] Field of Search ..... 209/215, 228, 209/223.1, 213, 214, 229; 15/105, 104.001, 160; 294/65.5; 335/285, 291, 293, 302, 303

[56] References Cited

U.S. PATENT DOCUMENTS

| | | | |
|---|---|---|---|
| 2,426,795 | 9/1947 | Sjostrom | 29/215 |
| 2,654,480 | 10/1953 | Stem | 209/229 |
| 3,377,641 | 4/1968 | McGregor | 209/215 |
| 3,646,492 | 2/1972 | Westerman | 209/215 |
| 4,554,703 | 11/1985 | Matuki | 209/215 |
| 4,598,439 | 7/1986 | Good | 15/339 |
| 4,929,345 | 5/1990 | Meador | 209/215 |
| 5,285,094 | 2/1994 | Haase | 209/228 |
| 5,413,225 | 5/1995 | Shields | 209/228 |
| 5,624,146 | 4/1997 | De Los Reyes | 294/65.5 |

*Primary Examiner*—Robert J. Oberleitner
*Assistant Examiner*—C. T. Bartz
*Attorney, Agent, or Firm*—John James

[57] ABSTRACT

The Plastic Magnetic Sweeper is designed with lightweight plastic. Its overall weight is eighteen pounds or less. The load release system is contained inside handle. The Plastic Magnetic Sweeper is light weight for easy storage. The Plastic Magnetic Sweeper has a removeble wheel support bracket that is optional for use. The overall design of this tool is new to the art of removing metal objects from floors.

1 Claim, 5 Drawing Sheets

PLASTIC LIGHTWEIGHT MAGNETIC SWEEPER

The present invention relates to the sweeping and picking up metal objects off floors.

BACKGROUND OF INVENTION

The Plastic hand operated Magnetic Sweeper has always been needed in such businesses as: Sheet Metal Shops, Factory Assembly Plants, Roofing Industry, Recycling Plants, and Parking Lots. Out of these industries, the Plastic Lightweight Magnetic Sweeper was born.

Due to the need of maintaining a clean and safe environment in these industries, this tool was developed. Within the last 100 years, there has not been an invention such as the Plastic Lightweight Hand Operated Magnetic Sweeper.

The Plastic Lightweight Hand Operated Magnetic Sweeper is the solution to todays problem of cleaning areas of small pieces of metal objects. The Plastic Lightweight Hand Magnetic Sweeper enables a person to get into small places to get metal. It is also very light so that a person can lift steel metal objects off the floor. Its weight is only eighteen pounds or less. It also allows a person the ability to pick-up metal and release metal with the push and pull of the handle. It also has two inch rubber wheel casters and a eleven inch roller bar which helps it to roll across the floor easily. This is optional for this tool.

SUMMARY OF INVENTION

The Plastic Lightweight Hand Operated Magnetic Sweeper meets all the requirements for an effective way to pick-up and release metal faster and easier than its competitor. It is also different that it is the only one of its kind to be designed of P.V.C. plastics, which opens the door for a full line of Plastic Magnetic Sweepers. The load release system is very unique within itself. It is designed so that by pushing in and turning the spring loaded handle, it handle, locks the magnetic plate in a pick up position. By reversing the process and pulling the spring loaded handle out, releases all the metal objects the sweeper has picked up. The magnetic case was designed in such a way, to give the tool the advantage to serve as an all purpose tool in the Magnetic Sweeper industry. The Magnetic case can be re-designed for use on a smaller scale. The Load Release Handle is attached to the magnetic case and is strengthened by a stabilizing bracket which gives the tool its strength and make the tool more durable and stronger, to perform the duties as needed. The 1½×12 felt on front of the case, serve as a floor brush to sweep up very small pieces of metal. The magnetic case has a belt around the bottom of the case to protect it from damage while in use.

DETAILED DESCRIPTION

The handle Cap 1 has a hanging loop for easy storage in safe places. The handle cap 1 is part of the load release handle 2 as shown in FIG. 3.

Figure 1:
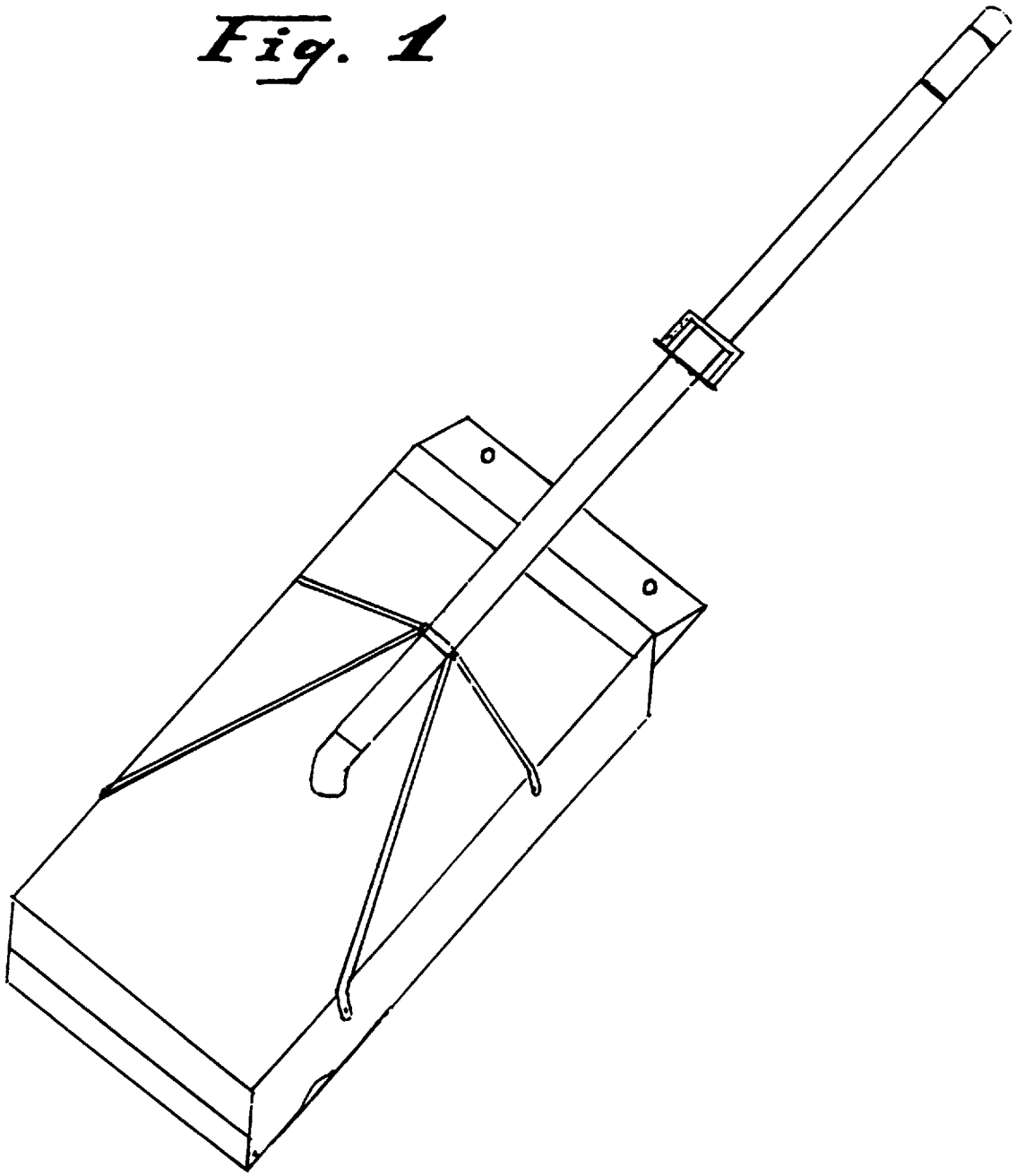
FIG. 1, is a diagrammatic perspective view of one design for the Plastic Magnetic Sweeper.
Figure 2:
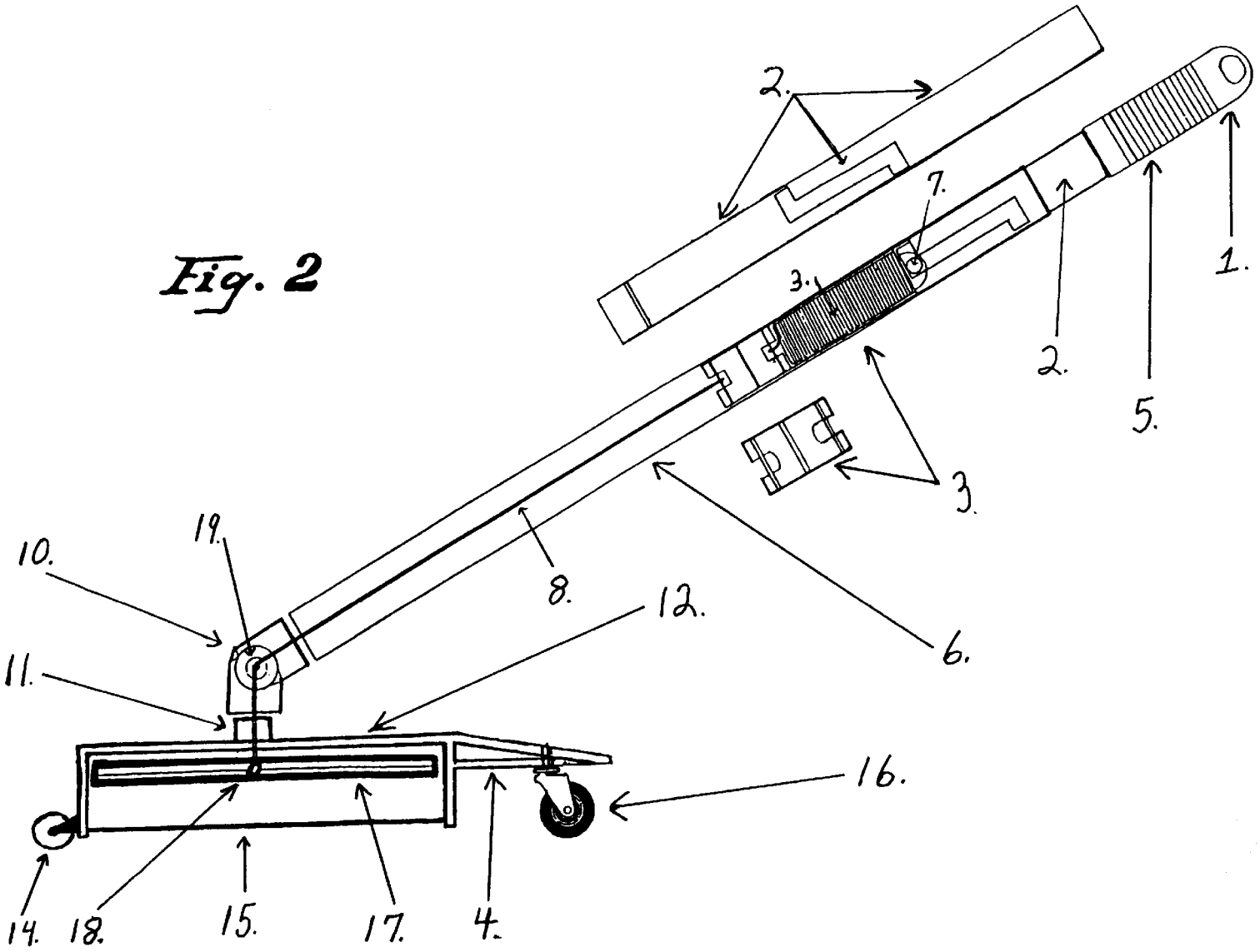
FIG. 2, is a diagrammatic perspective view of the Plastic Magnetic Sweeper showing all of its components, 1 through 21.
Figure 3:
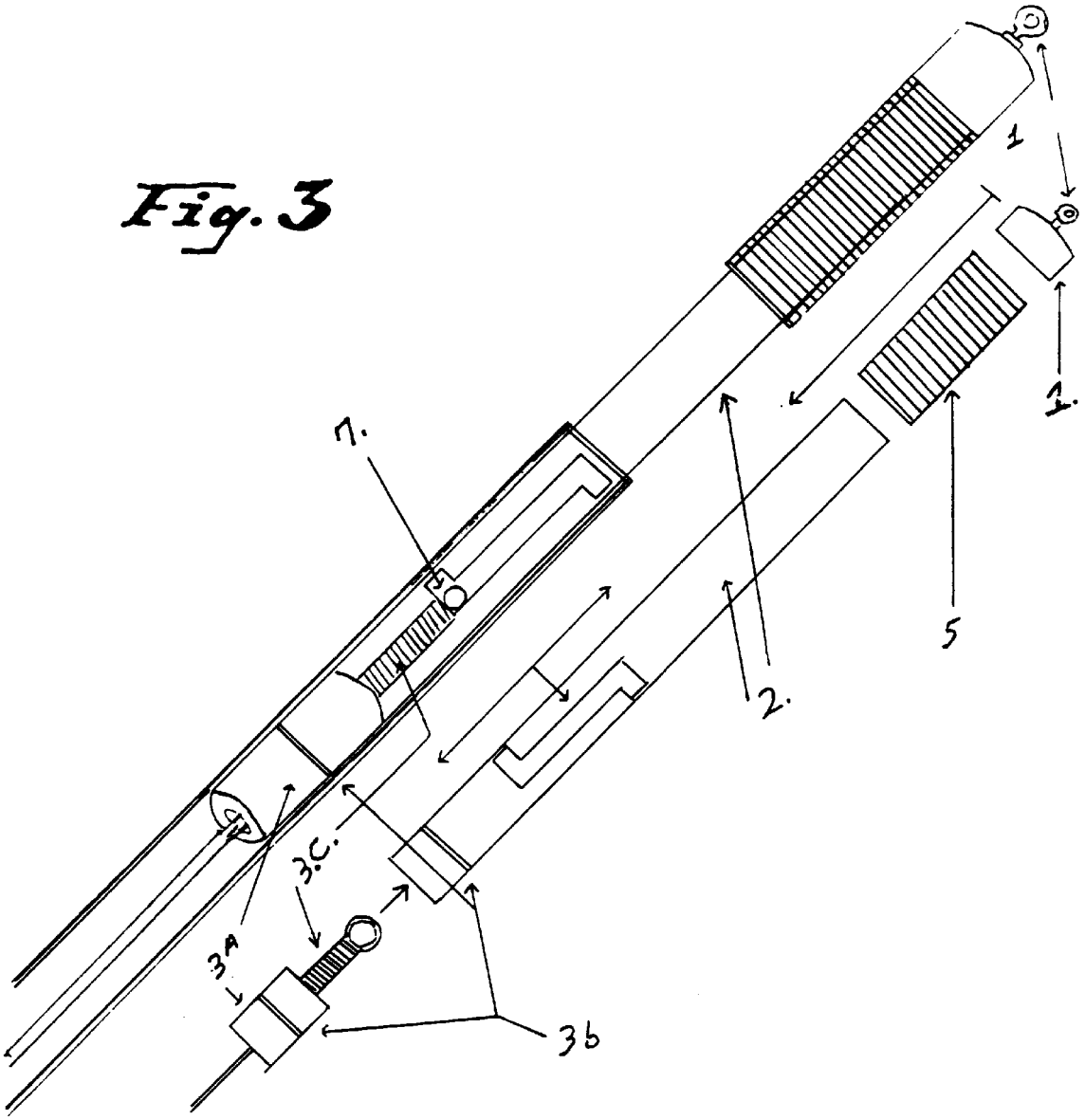
FIG. 3, is a diagrammatic perspective view of the Load Release System and its components and how the Release System operates.

The load release handle 2 in FIG. 3 consists of several components in the load release handle 2 itself. Also attached to the load release handle 2 is the handle cap 1 and handle grip 5 as shown in FIG. 3

The load release handle 2 itself has a S- shaped slot in it which allows it to move from the pickup position to the release position. The spring and cable support 3 *a* as shown lock-in pin 3*b*. The spring 3*c* of the Spring and Cable Support 3*a* is attached to the lock-in bolt 7, only after the load release handle 2 has been installed with cable entering first.

The lock-in bolt 7 goes though the handle extension 6 into the load release handle 2; then through the spring 3*c* and out the other side of the handle extension 6.

This can only be done with the load release handle 2 in a releases position.

The steel cable 8 from the load release handle 3 runs though the handle extension 6 to a plastic elbow 10 though the cable wheel guide 19 and plastic coupling into the magnetic case 12.

The Steel Cable 8 is attached to the magnetic pickup plate 17 by a cable holding pin 18, only when the load release handle 2 is in the pick up position.

Figure 4:
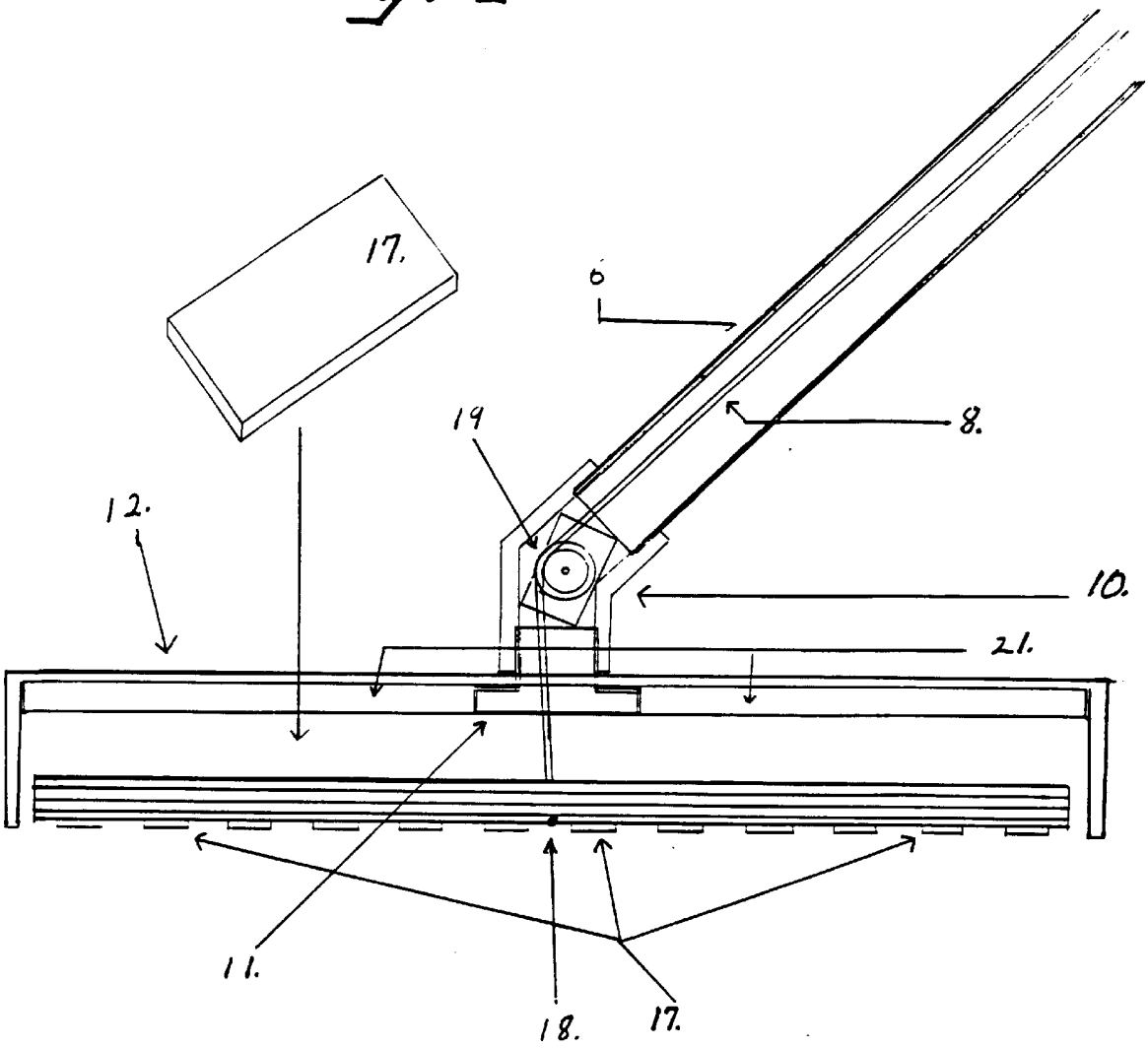
FIG. 4, is a diagrammatic perspective view of the Magnetic Pick-up Plate and its components and how they operate.

The handle extension 6 is connected to a 45 degree plastic elbow 10 where the cable guide 19 is enclosedndle extension 6, plastic elbow 10, and cable guide 19 are connected to the magnetic case 12 by plastic coupling as shown in FIG. 4.

Figure 5:
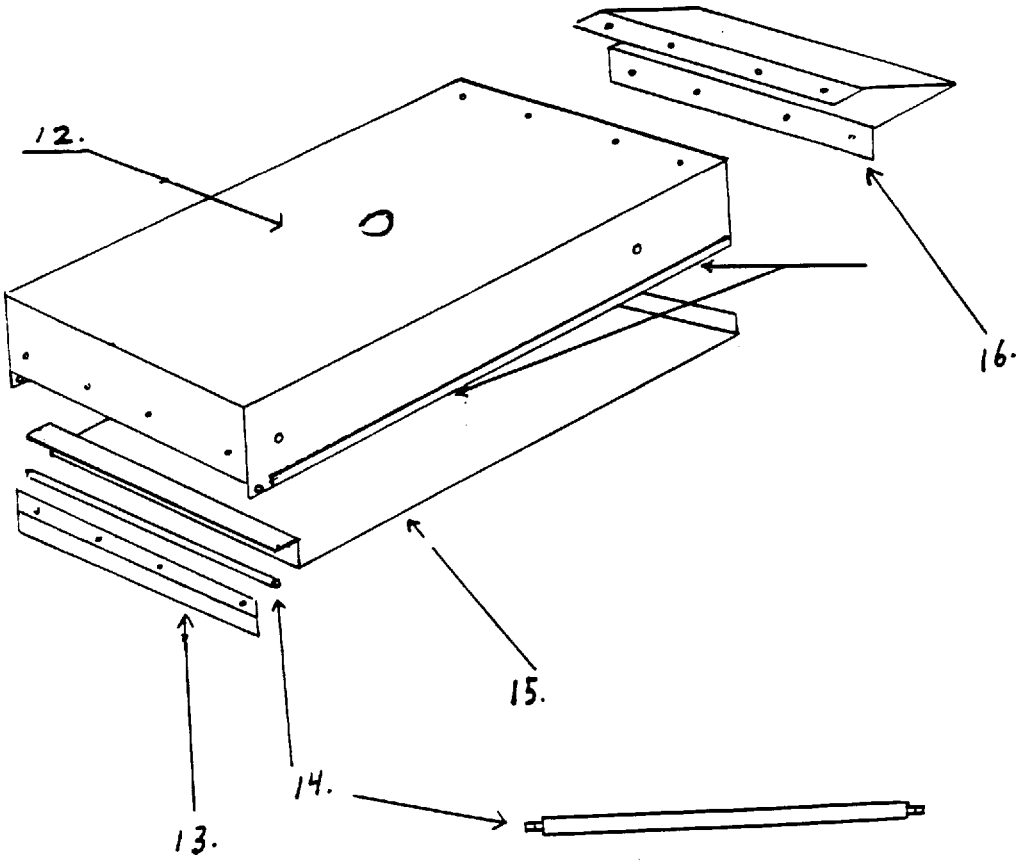
FIG. 5, shows a diagrammatic perspective view of the Plastic Magnetic Sweeper Case and its rear wheel bracket system.

In FIG. 5 the magnetic case 12 is shown with the rear wheel support bracket 4, front roller wheel bar 14, felt floor sweeper bar 13, and the bottom case plate 15 are shown. The bottom case plate 15 must be installed In "C" Channel 22 before operation begins.

The claims for the Plastic Magnetic Sweeper are as follows:

1. A load release mechanism, consisting of a magnetic floor sweeper having at its lower end a case, and a handle attached to said case;

said case consisting of an upper end, and four side ends, two side ends of said case affixed to and at opposite sides of said magnetic floor sweeper, two other side ends of said case at the front and back of said magnetic floor sweeper, said case also having a case plate at the bottom end of said case, said case plate being adjacent to and affixed to all of said side ends of said case, said case plate being permeable to a magnetic field;

a magnetic cover plate within said case, and of a similar size to the case plate and which maintains a position covering said case plate, said magnetic cover plate having at least two positions relative to the floor sweeper, a lower position and an upper position, said magnetic cover plate capable of moving in such a way that each and every point of said magnetic cover plate is at the same distance from said case plate in each of said lower and upper positions with respect to said case plate;

said handle consisting of a hollow rod with said lower end affixed to said upper end of said case, and a cable passing through said inside of said rod, said lower end of said cable passing with clearance through a hole in said upper end of said case and further being affixed at said lower end of said cable to said magnetic cover plate, said upper end of said cable passing through a hollow fastening which is affixed inside said handle and secured immovably at a position within the length of said handle, said cable further passing through a spring entirely contained within said handle and at the upper end of said hollow fastening, said spring being fastened at its lower end to said upper end of said hollow fastening and at said upper end to a lock-in bolt, and said upper end of said cable also affixed to said lock-in bolt, said lock-in bolt capable of moving within an S-shaped slot placed within each of said two opposing sides of said hollow handle;

said S-shaped slot having three portions, a center portion and two end portions, said center portion having two opposite ends and passing through opposite sides of said hollow handle and positioned parallel to the longitudinal extent of said handle, each of said end portions of said S-shaped slot also passing through said opposite sides of said hollow handle and further occurring at said two opposite ends of said center portion of said S-shaped slot, said end portions of said S-shaped slot functioning as detent points for said lock-in bolt attached to said upper end of said cable in such a manner that when said lock-in bolt is placed in said lower end portion of said S-shaped slot, said magnetic cover plate at said lower end of said cable is in its lower position, and when said lock-in bolt is placed in said upper end portion of said slot, said magnetic cover plate at said lower end of said cable is in its upper position.

* * * * *